US010121611B2

(12) United States Patent
Cheng

(10) Patent No.: US 10,121,611 B2
(45) Date of Patent: Nov. 6, 2018

(54) MEMBRANE SWITCH

(71) Applicant: JENSIN INTL TECHNOLOGY CORP., New Taipei (TW)

(72) Inventor: Hsu-Feng Cheng, New Taipei (TW)

(73) Assignee: JENSIN INTL TECHNOLOGY CORP., New Taipei (TW)

( * ) Notice: Subject to any disclaimer, the term of this patent is extended or adjusted under 35 U.S.C. 154(b) by 0 days.

(21) Appl. No.: 15/682,554

(22) Filed: Aug. 22, 2017

(65) Prior Publication Data

US 2018/0240617 A1 Aug. 23, 2018

(30) Foreign Application Priority Data

Feb. 23, 2017 (TW) ..... 106106218 A

(51) Int. Cl.
*H01H 13/02* (2006.01)
*H01H 13/50* (2006.01)

(52) U.S. Cl.
CPC ..... *H01H 13/02* (2013.01); *H01H 13/50* (2013.01); *H01H 2227/01* (2013.01); *H01H 2229/002* (2013.01)

(58) Field of Classification Search
CPC .... H01H 13/02; H01H 13/50; H01H 2227/01; H01H 2229/002; H01H 13/82; H01H 2213/01
USPC ..... 200/238, 5 A, 406, 515, 516
See application file for complete search history.

(56) References Cited

U.S. PATENT DOCUMENTS

| | | | | |
|---|---|---|---|---|
| 4,046,975 | A * | 9/1977 | Seeger, Jr. | H01H 13/702 200/302.2 |
| 6,797,906 | B2 * | 9/2004 | Ohashi | H01H 3/125 200/306 |
| 9,870,880 | B2 * | 1/2018 | Zercoe | H01H 13/06 |
| 2005/0121299 | A1 | 6/2005 | Ide et al. | |

FOREIGN PATENT DOCUMENTS

| | | |
|---|---|---|
| CN | 106158480 | 11/2016 |
| JP | 2001035305 | 2/2001 |
| TW | M311110 | 5/2007 |
| TW | 200839823 | 10/2008 |
| TW | M405594 | 6/2011 |

* cited by examiner

*Primary Examiner* — Edwin A. Leon
(74) *Attorney, Agent, or Firm* — JCIPRNET

(57) ABSTRACT

A membrane switch including a first membrane, a second membrane, a first electrode disposed on the first membrane, a second electrode disposed on the second membrane, and an adhesive layer is provided. The first membrane and the second membrane are combined to each other by the adhesive layer, such that the first electrode faces the second electrode and a gap exists therebetween. At least one air tunnel is formed in the adhesive layer to communicate the gap with an external environment.

10 Claims, 4 Drawing Sheets

MEMBRANE SWITCH

CROSS-REFERENCE TO RELATED APPLICATION

This application claims the priority benefit of Taiwan application serial no. 106106218, filed on Feb. 23, 2017. The entirety of the above-mentioned patent application is hereby incorporated by reference herein and made a part of this specification.

BACKGROUND OF THE INVENTION

Field of the Invention

The invention relates to a membrane switch.

Description of Related Art

In a membrane switch, a plurality of touch portions respectively disposed on inner surfaces of two opposite thin films are pressed by an external force such that two corresponding touch portions contact each other and a circuit is conducted to thereby achieve an expected switch function and generate a signal. By combining multiple sets of membrane switches and connecting them by a circuit, a set of input device is formed.

Being light in weight and thin in size, the membrane switch has been generally applied to various electronic products (e.g., operation panels for mobile phones, household appliances, machine tools, etc.) in recent years. Particularly, as the electronic products are currently being developed to become light and small, it is especially important that the membrane switch satisfy these demands.

SUMMARY OF THE INVENTION

The invention provides a membrane switch that has a simplified structure and is effectively configured to be light and thin.

The membrane switch of the invention includes a first membrane, a second membrane, a first electrode, a second electrode, and an adhesive layer. The first electrode is disposed on the first membrane, the second electrode is disposed on the second membrane, and the first electrode and the second electrode face each other. The first membrane and the second membrane are combined by the adhesive layer such that a gap exists between the first electrode and the second electrode, wherein at least one air tunnel is formed in the adhesive layer to communicate the gap with an external environment.

In an embodiment of the invention, the adhesive layer is coated on at least one of the first membrane and the second membrane by a screen printing method and the at least one air tunnel is formed simultaneously with the coating.

In an embodiment of the invention, the membrane switch further includes at least one insulating layer disposed on at least one of the first membrane and the second membrane, the at least one insulating layer is located between the adhesive layer and the first membrane or between the adhesive layer and the second membrane.

In an embodiment of the invention, the at least one insulating layer includes a first insulating layer and a second insulating layer, the first insulating layer is located between the adhesive layer and the first membrane, and the second insulating layer is located between the adhesive layer and the second membrane.

In an embodiment of the invention, the at least one insulating layer fully covers the first membrane except a region of the first electrode.

In an embodiment of the invention, the at least one insulating layer fully covers the second membrane except a region of the second electrode.

In an embodiment of the invention, the adhesive layer is a hot melt adhesive or a pressure sensitive adhesive (PSA).

In an embodiment of the invention, a melting point of the hot melt adhesive is 130° C. to 150° C.

In an embodiment of the invention, a thickness of the insulating layer is 10 μm to 20 μm.

In an embodiment of the invention, a thickness of the adhesive layer is 10 μm to 20 μm.

In light of the above, in the foregoing embodiments of the invention, the first membrane and the second membrane are directly structurally combined with each other merely by the adhesive layer. Such arrangement eliminates the thickness of a compartment layer which still exists in the existing art and thus effectively configures the membrane switch to be light and thin. Meanwhile, since the overall thickness is reduced, a space between the first electrode and the second electrode in a hole size as presented in a top view is also reduced. In other words, a region between the first membrane and the second membrane that may be used to dispose the adhesive layer is significantly increased, which further enhances a waterproofing effect of the membrane switch.

To provide a further understanding of the aforementioned and other features and advantages of the invention, exemplary embodiments, together with the reference drawings, are described in detail below.

DESCRIPTION OF THE EMBODIMENTS

Figure 1:
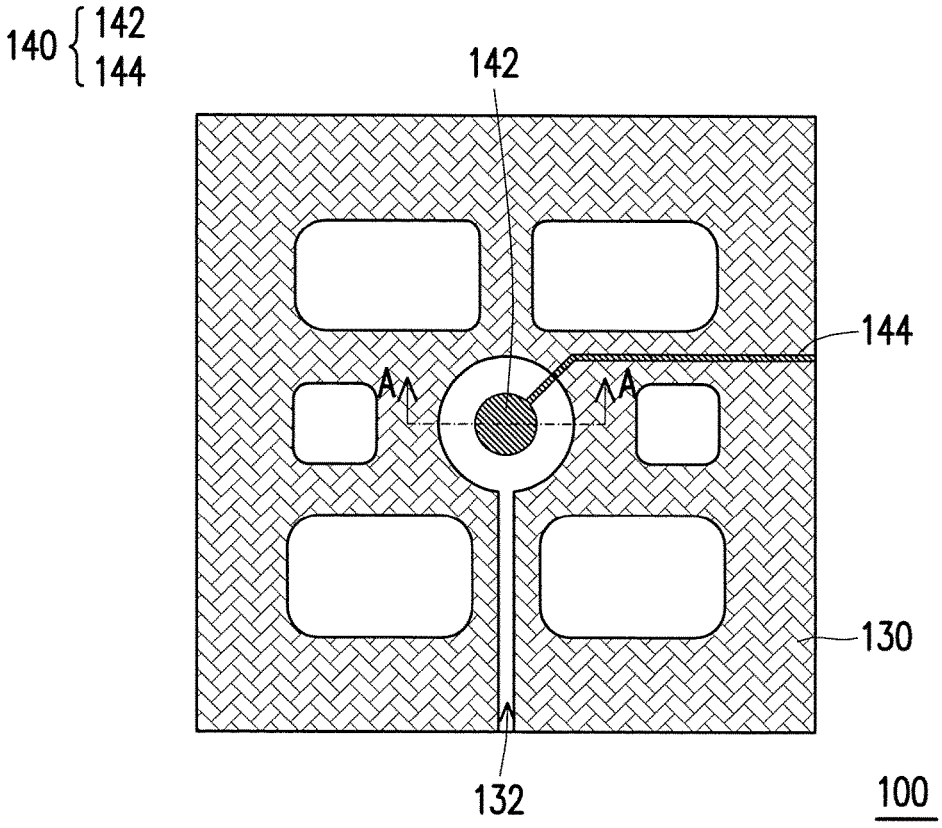
FIG. 1 is a top view illustrating a membrane switch according to an embodiment of the invention.
Figure 2:
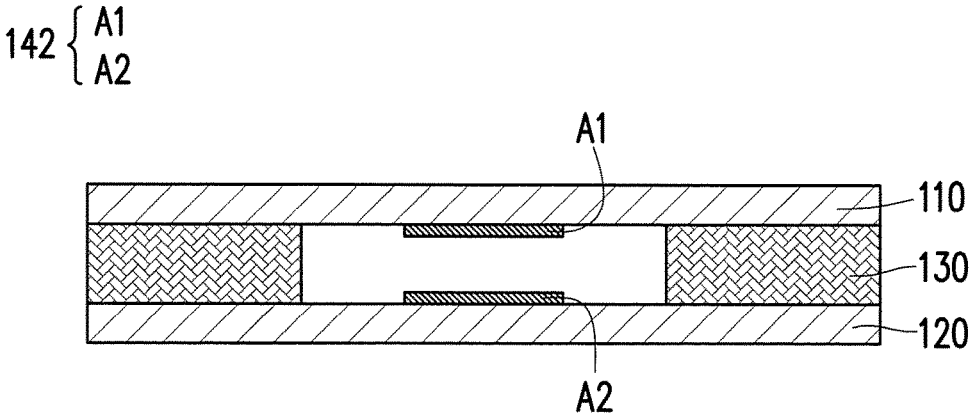
FIG. 2 is a sectional view illustrating the membrane switch of FIG. 1 along a line A-A.

FIG. 1 is a top view illustrating a membrane switch according to an embodiment of the invention. FIG. 2 is a sectional view illustrating the membrane switch of FIG. 1 along a line A-A, wherein part of the components of FIG. 1 are not shown in FIG. 2 to better identify an internal structure thereof. Referring to both FIG. 1 and FIG. 2, in the present embodiment, a membrane switch 100 includes a first membrane 110, a second membrane 120, and an adhesive layer 130, wherein the first membrane 110 and the second membrane 120 are combined to each other merely by the adhesive layer 130. Moreover, a conductive layer 140 including a line 144 and an electrode pair 142 is disposed between the first membrane 110 and the second membrane 120. The electrode pair 142 includes a first electrode A1 disposed on the first membrane 110 and a second electrode A2 disposed on the second membrane 120. As illustrated in FIG. 2, the first electrode A1 and the second electrode A2 face to each other and a gap exists between the two electrodes A1, A2 to be acted as a touch portion of the membrane switch 100. When an external force presses the membrane switch 100 and causes the first electrode A1 and the second electrode A2 to be press-connected and electrically conducted to each other (i.e., the electrodes contact each other), a conduction signal generated therefrom is transmitted to a control element (not illustrated) via the line 144 to generate an expected switch driving signal for achieving activating effect of the membrane switch 100. When the external force is removed, by elasticity of the first membrane 110 and the second membrane 120, the membrane switch 100 is restored to a state as shown in FIG. 2 where the first electrode A1 and the second electrode A2 are separated from each other.

It shall be mentioned here that the membrane switch in the existing art is invariably provided with a compartment layer between the first membrane and the second membrane, while the present embodiment merely provides the adhesive layer 130 and it is not necessary to dispose an additional compartment layer between the first membrane 110 and the second membrane 120 (i.e., only one adhesive layer exists, or it can be seen that no compartment layer exists between the adhesive layer), such that the membrane switch 100 of the present embodiment can achieve better effect of becoming light and thin. Such arrangement further reduces a hole size formed by a peripheral space (i.e., a blank portion about the electrode pair 142 as in FIG. 1) of the electrode pair 142 when viewed from a top.

More specifically, in the existing art, due to the existence of the compartment layer (with a thickness of about 50 μm), the first electrode and the second electrode need to pass through a compartment hole of the compartment layer to contact each other. Accordingly, limited by the compartment hole, the peripheral space of the first electrode on the first membrane needs to be larger than a hole size of the compartment hole so that the first electrode can pass through the compartment hole when the first membrane is pressed, which means the peripheral space is used for deformation of the first membrane. The same situation also occurs to the second electrode on the second membrane. In an example of a membrane switch with a load of 8 g to 18 g, when the compartment layer exists, the hole size formed by the peripheral space of the first electrode (or the second electrode) when viewed from the top is 3.6 mm to 3.8 mm. Accordingly, in the membrane switch in the existing art, more space needs to be provided in the periphery of the electrode pair so that the electrode pair is in contact when the membranes are pressed. By contrast, in the present embodiment, due to the absence of the compartment layer, the peripheral space of the electrode pair 142 is reduced accordingly. For example, the hole size formed by the peripheral space of the electrode pair 142 when viewed from the top is 2.8 mm to 3.0 mm. In other words, a region on the first membrane 110 or/and the second membrane 120 on which the adhesive layer 130 may be coated is increased, which enhances a waterproofing effect of the membrane switch 100.

Moreover, the adhesive layer 130 of the present embodiment is a hot melt adhesive or a pressure sensitive adhesive (PSA) that is coated on at least one of the first membrane 110 and the second membrane 120 by a screen printing method. Accordingly, a thickness of the adhesive layer 130 may be 10 μm to 20 μm. Meanwhile, where the hot melt adhesive is used, a melting point thereof is 130° C. to 150° C. Due to such arrangement, the hot melt adhesive does not easily melt when the membrane switch 100 undergoes other subsequent relevant processes. In terms of the thickness, in the existing art, due to the existence of the compartment layer, an adhesive layer further needs to be coated on two opposite surfaces of the compartment layer to attach the compartment layer to the first membrane and the second membrane. Therefore, an interval of about 90 μm is formed between the first membrane and the second membrane. By contrast, in the present embodiment, since only the adhesive layer 130 is attached to the first membrane 110 and the second membrane 120, the interval between the first membrane 110 and the second membrane 120 is effectively controlled to be the thickness of the adhesive layer 130 (i.e., 10 μm to 20 μm as mentioned above).

In addition, more importantly, as illustrated in FIG. 1, while the adhesive layer 130 of the present embodiment is coated, an air tunnel 132 is simultaneously formed. In other words, when viewed from an angle shown in FIG. 2, the air tunnel 132 and the adhesive layer 130 are substantially on the same plane, and the air tunnel 132 is adapted to connect the gap between the electrode pair 142 with an external environment. As mentioned above, the adhesive layer 130 is coated by the screen printing method. Therefore, through a structural design of a screen, while a user coats the adhesive layer 130 on the first membrane 110 or/and the second membrane 120, the required air tunnel 132 (i.e., a region not coated with the adhesive layer 130) is already formed. Put differently, since the compartment layer of the existing art is not required in the present embodiment, when the first membrane 110 and the second membrane 120 are attached, alignment is performed only based on the first electrode A1 and the second electrode A2, and it is not necessary to consider alignment of the compartment hole of the compartment layer. Therefore, the manufacturing process and costs are effectively reduced. Meanwhile, forming the air tunnel 132 simultaneously with the adhesive layer 130 also saves the manufacturing process and costs for additionally constructing an air tunnel structure as required in the existing art.

Figure 3:
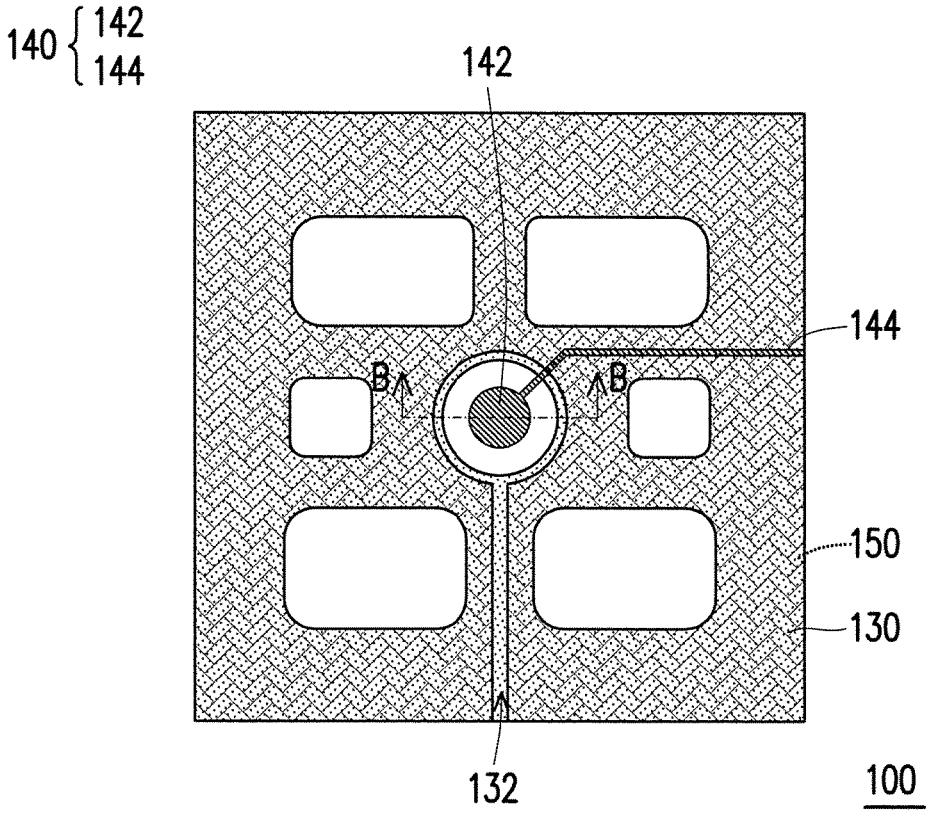
FIG. 3 is a top view illustrating a membrane switch according to another embodiment of the invention.
Figure 4:
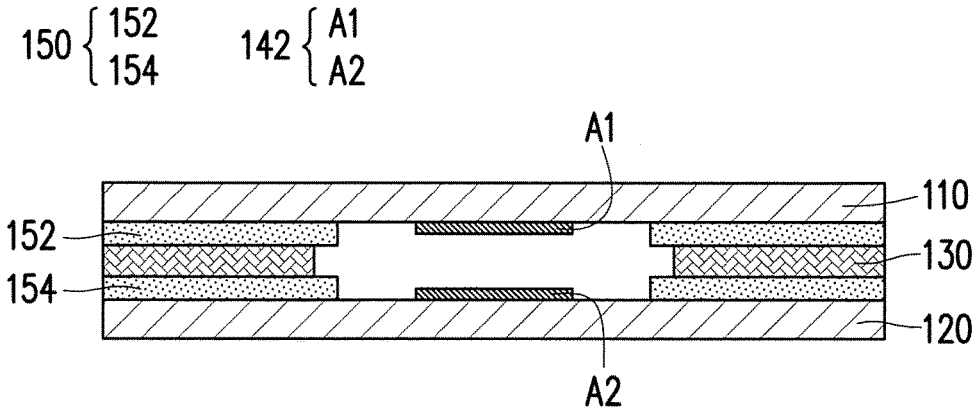
FIG. 4 is a sectional view illustrating the membrane switch of FIG. 3 along a line B-B.

FIG. 3 is a top view illustrating a membrane switch according to another embodiment of the invention. FIG. 4 is a sectional view illustrating the membrane switch of FIG. 3 along a line B-B. Referring to both FIG. 3 and FIG. 4, different from the foregoing embodiment, the membrane switch 100 of the present embodiment further includes an insulating structure 150 disposed between the adhesive layer 130 and the membranes. Here, the insulating structure 150 includes a first insulating layer 152 and a second insulating layer 154 respectively with a thickness of 10 μm to 20 μm. Specifically, the first insulating layer 152 is disposed between the adhesive layer 130 and the first membrane 110, and the second insulating layer 154 is disposed between the adhesive layer 130 and the second membrane 120 to thereby provide an insulating effect between the conductive layer 140. In terms of the thickness, a sum of thickness of the adhesive layer 130, the first insulating layer 152, and the second insulating layer 154 of the present embodiment is 60 μm, which is still smaller than the thickness of 90 μm, including the compartment layer and the adhesive layer, in the existing art.

It shall be noted here that the first insulating layer 152 substantially fully covers the first membrane 110 except a region of the first electrode A1, and the second insulating layer 154 fully covers the second membrane 120 except a region of the second electrode A2. As illustrated in FIG. 3, dots indicate the region where the insulating structure exists, and its range substantially covers the line 144 and the air tunnel 132. In other words, the insulating structure 150 does not cover the electrode pair 142 and its peripheral region only. Therefore, in addition to providing sufficient insulating effect, manufacturing is completed merely by covering an insulating membrane of an integral structure on the first membrane 110 and the second membrane 120.

It shall be noted that in the existing art, the membrane switch uses the compartment layer for insulation. As described above, the compartment hole further needs to be formed in the compartment layer to allow contact of the electrode pair. A larger number of the electrode pairs will mean that a number of the compartment holes of the compartment layer needs to be increased, which causes the compartment layer to tend to be scattered(fractured) in the manufacturing process due to excessive compartment holes. This is also unfavorable for alignment and attachment with the membranes and is unfavorable for the overall structural strength. By contrast, the insulating membrane of the integral structure allows more convenient and precise attachment and alignment in the manufacturing process.

Figure 5:
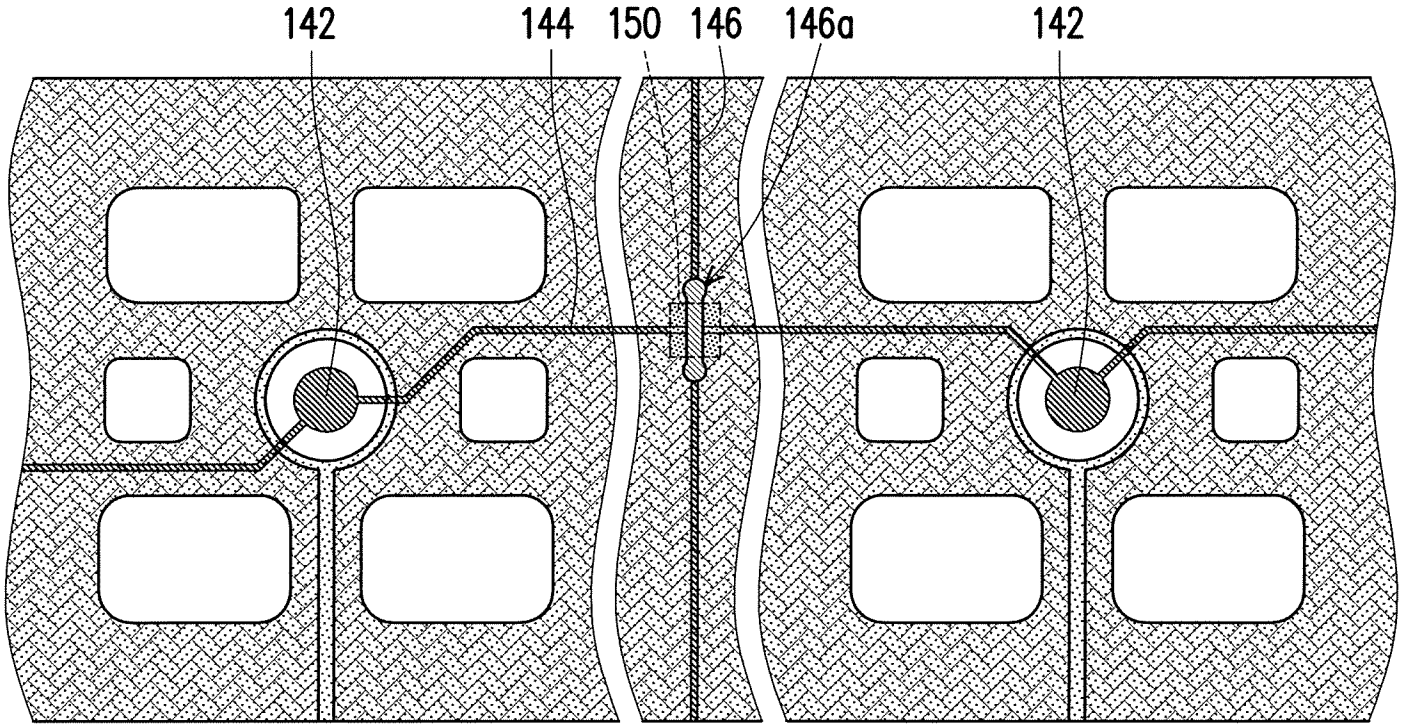
FIG. 5 is a partial top view illustrating a membrane switch according to another embodiment of the invention.

In addition, FIG. 5 is a partial top view illustrating a membrane switch according to another embodiment of the invention. Here, part of the structure of two adjacent membrane switches is illustrated. Referring to FIG. 5, as described above, in addition to enhancing manufacturing efficiency, the insulating membrane of the integral structure also contributes to certain convenience in the arrangement of a conductive line structure. As illustrated in the figure, the transverse line 144 and a longitudinal line 146 intersect in an interval region (indicated by a frame in a broken line) of the adjacent membrane switches 100. With the existence of the insulating structure 150 (dotted), a jumper wire structure 146*a* of the line 146 can easily cross over the line 144.

Figure 6:
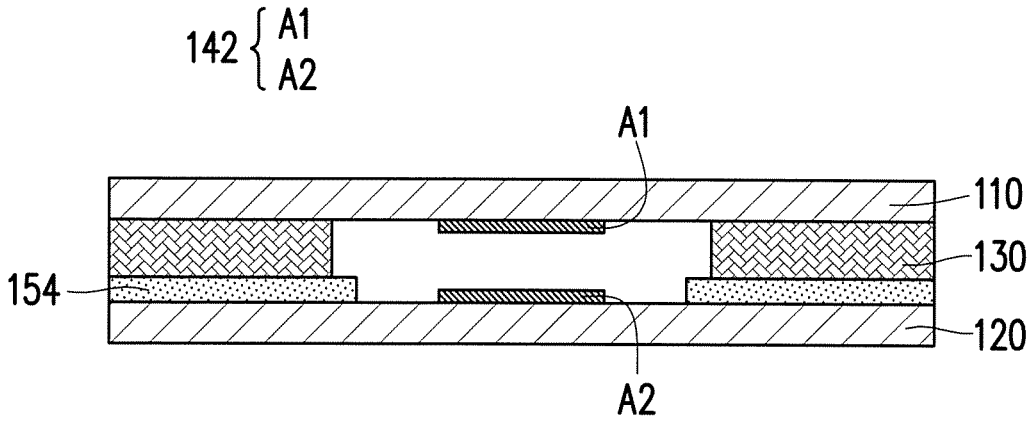
FIG. 6 is a partial sectional view illustrating a membrane switch according to another embodiment of the invention.

FIG. 6 is a partial sectional view illustrating a membrane switch according to another embodiment of the invention. Referring to FIG. 6, different from the foregoing embodiment, the membrane switch of the present embodiment includes only one layer of the insulating structure (the second insulating layer 154 shown in the figure, for example), which is disposed between the second membrane 120 and the adhesive layer 130). Similar to the foregoing embodiment, when viewed from the top of the membrane switch, the second insulating layer 154 also covers the second membrane 120 except the region of the second electrode A2 and can thus similarly provide insulation between the first membrane 110 and the second membrane 120.

In summary of the above, in the foregoing embodiments of the invention, the first membrane and the second membrane are directly structurally combined with each other merely by the adhesive layer. Such arrangement eliminates the thickness of the compartment layer which still exists in the existing art and thus effectively configures the membrane switch to be light and thin. Meanwhile, since the overall thickness is reduced, the space between the first electrode and the second electrode in the hole size as presented in the top view is also reduced. In other words, the region between the first membrane and the second membrane that may be used to dispose the adhesive layer is significantly increased, which further enhances the waterproofing effect of the membrane switch.

Moreover, the air tunnel of the membrane switch is collectively completed as the adhesive layer is coated by the screen printing method, which effectively simplifies the structure and avoids inconvenience resulting from additionally disposing the air tunnel with components and processes as required in the existing art.

In addition, by disposing at least one insulating layer between the first membrane and the second membrane, the insulating membrane of the integral structure replaces the compartment layer in the existing art, which requires arrangement of corresponding compartment holes. Accordingly, convenience in the manufacturing process is enhanced and the manufacturing costs are effectively lowered.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A membrane switch comprising:

a first membrane;

a first electrode disposed on the first membrane;

a second membrane;

a second electrode disposed on the second membrane, wherein the first electrode and the second electrode face each other; and an adhesive layer, the first membrane and the second membrane being combined by the adhesive layer such that a gap exists between the first electrode and the second electrode, wherein at least one air tunnel is formed in the adhesive layer and the at least one air tunnel communicates the gap with an external environment, and no compartment layer exists in the adhesive layer between the first membrane and the second membrane.

2. The membrane switch according to claim 1, wherein the adhesive layer is coated on at least one of the first membrane and the second membrane by a screen printing method and the at least one air tunnel is formed simultaneously with the coating.

3. The membrane switch according to claim 1, further comprising:

at least one insulating layer disposed on at least one of the first membrane and the second membrane, the at least one insulating layer located between the adhesive layer and the first membrane or located between the adhesive layer and the second membrane.

4. The membrane switch according to claim 3, wherein the at least one insulating layer comprises a first insulating layer and a second insulating layer, the first insulating layer located between the adhesive layer and the first membrane, and the second insulating layer located between the adhesive layer and the second membrane.

5. The membrane switch according to claim 3, wherein the at least one insulating layer fully covers the first membrane except a region of the first electrode.

6. The membrane switch according to claim 1, wherein the at least one insulating layer fully covers the second membrane except a region of the second electrode.

7. The membrane switch according to claim 1, wherein the adhesive layer is a hot melt adhesive or a pressure sensitive adhesive (PSA).

8. The membrane switch according to claim 7, wherein a melting point of the hot melt adhesive is 130° C. to 150° C.

9. The membrane switch according to claim 3, wherein a thickness of the at least one insulating layer is 10 μm to 20 μm.

10. The membrane switch according to claim 1, wherein a thickness of the adhesive layer is 10 μm to 20 μm.

* * * * *